United States Patent [19]

Bennett

[11] 4,157,812

[45] Jun. 12, 1979

[54] SHIP MOTION COMPENSATOR FOR RECOVERY OF OCEANOGRAPHIC INSTRUMENTATION

[75] Inventor: Derek J. Bennett, Thousand Oaks, Calif.

[73] Assignee: Bunker Ramo Corporation, Oak Brook, Ill.

[21] Appl. No.: 824,725

[22] Filed: Aug. 15, 1977

[51] Int. Cl.[2] ..... B66D 1/48

[52] U.S. Cl. ..... 254/172; 254/178; 242/107.1

[58] Field of Search ..... 254/172, 178, 139, 184; 191/122 R; 267/136, 137; 212/3; 242/107, 107.1

[56] References Cited

U.S. PATENT DOCUMENTS

| | | | |
|---|---|---|---|
| 1,313,719 | 8/1919 | Miller | 254/172 |
| 3,150,860 | 9/1964 | Nelson | 254/172 |
| 3,615,065 | 10/1971 | Elliott | 254/178 |
| 3,826,023 | 7/1974 | Koning et al. | 254/172 |
| 4,003,552 | 1/1977 | Sobolewski | 254/178 |
| 4,053,118 | 10/1977 | Aikins | 191/12.2 R |

*Primary Examiner*—Trygve M. Blix
*Assistant Examiner*—Kenneth W. Noland
*Attorney, Agent, or Firm*—F. M. Arbuckle; A. Freilich

[57] ABSTRACT

Apparatus for compensating ship motion for sea-state conditions in order to protect oceanographic instrumentation which would normally be subjected to loss due to high shock loads in the instrumentation cable by which it is supported. The apparatus utilizes large power springs attached to a compensator cable and sheave through which the instrumentation cable is reeved. The spring reduces the suspension frequency of the instrumentation cable below the ship excitation frequency so that the motion from the ship can be isolated from the instrumentation cable. These springs may be in the form of spirally-wound flat strips of high-tensile alloy which, when wound, exert a torque to the compensator cable reel such that the tension on the instrumentation cable can be maintained fairly uniform.

2 Claims, 5 Drawing Figures

SHIP MOTION COMPENSATOR FOR RECOVERY OF OCEANOGRAPHIC INSTRUMENTATION

BACKGROUND OF THE INVENTION

This invention relates to apparatus for compensating ship motion and sea-state conditions in order to protect oceanographic instrumentation suspended on a support cable that might otherwise part during use or recovery due to high shock loads in the support or instrumentation cable.

Recovery of advanced sonobuoys poses a problem for test and evaluation. During high sea-state conditions, the sonobuoy sensor is susceptible to loss due to high transient shock loads in the cable. A ship motion compensator is required that will greatly increase the probability of recovery for both "A" and "B" size sonobuoy stores.

The general trend in advanced sonobuoy design is to place the sensor very deep in the water column. This requirement to go deep is predicated on achieving greater acoustic range and higher probability of detection. With the need to go deep the amount of cable used places greater demands on the package volume. This in turn leads to cables of small diameter with minimal factors of safety.

Design consideration is always given to ensure that the forces on the sonobuoy cable, during both its deployment and operation phases, do not exceed the breaking strength. For test and evaluation purposes, the same consideration should be given during the recovery of the cable and sensor. Unfortunately, the recovery in many instances represents the worst case situation; a surface vessel is used and the cable is normally reeled directly on a deck winch. Under these conditions high snaploads are likely to occur.

It is axiomatic that test and evaluation is often required when the recovery conditions are at their worst, and this is often necessary so that the effect of high sea states on sonobuoy performance can be examined. To ensure reliable recovery of all deep sonobuoys, a means, passive or active, of eliminating these high shock loads is required.

Prior art techniques may be divided into two general methods of eliminating transient dynamic loads in suspension cables. These divisions are known as "active" and "passive" compensation methods. The "active" method reduces the dynamic loads by sensing the transient onset and adjusting the amount of cable payed out. Two examples of this type of compensation are: a constant tension winch, built by Pratt and Whitney for Scripps Institute of Oceanography, and a constant tension crane built by Ocean Systems Engineering for the Navy. This type of machinery is inherently complex, massive and very expensive. Its utility lies in the deployment and recovery of very large and heavy cables where the dynamic conditions vary over such a large range that the use of a "passive" compensator would be impossible.

A "passive" compensator relies on reducing the dynamic loads by "tuning" the suspension frequency below the excitation frequency. The compensator therefore becomes a low-rate spring inserted between the deck winch and the suspended cable. In the past, methods of implementing this low-rate spring have included the pneumatic/hydraulic ram and rubber bungee, as just noted.

Both of these methods leave a lot to be desired. To compensate for large motions (10 to 15 feet) the size and complexity of the pneumatic ram method becomes unattractive. The bungee rubber method provides a low cost approach. However, much of this advantage is offset by its tendency to deteriorate rapidly with usage and sunlight. Also, terminations made to the bungee are very unreliable and are likely to fail at the most inconvenient moment. To obtain the high strength and low spring rate, very long lengths of bungee are required. This in turn leads to very complex sheave arrangements.

Still another passive technique consists of the use of a spring-loaded drum. Typical systems using this alternative passive technique are disclosed in U.S. Pat. No. 3,020,567. Spiral springs have been used in other applications such as in tensioning a tagline in a crane mechanism, as shown in U.S. Pat. No. 2,367,912; retrieving electrical cable and the like as shown in U.S. Pat. No. 3,033,488; and in suspending a bucket or the like at the end of a hoist cable. Other applications of spiral-type tension springs in connection with cable retrieval are disclosed in U.S. Pat. Nos. 3,593,941 and 2,130,504. However, although spiral springs have been used in applications for providing constant tension, they have not been employed as motion compensators in a cable retrieval system. The advantage of so using a spiral spring resides in the ability to select a tension, by using the appropriate reel diameter for a given spring tension, and in the need to reel the cable through only one sheave in providing the desired tension compensation to reduce the fatigue stressing the cable fiber.

SUMMARY OF THE INVENTION

In a preferred embodiment, compensation for ship motion and sea-state conditions is provided, in order to protect oceanographic instrumentation which could be subjected to loss due to high shock loads in instrumentation cable, utilizing power springs to reduce the suspension frequency below the ship excitation frequency, thus isolating ship motion from the cable. The springs may be in the form of spirally-wound flat strips of high tensile alloy which, when wound, exert a torque to a compensator cable reel attached to a sheave through which the instrumentation cable is reeved, thereby to maintain the tension on the instrumentation cable fairly uniform. A crane may be employed with a second sheave to suspend the cable over the side of the ship without significantly affecting the motion isolation achieved by the power springs, and a deck winch or similar means may be employed to pay out or pull in the instrumentation package.

The novel features that are considered characteristic of this invention are set forth with particularity in the appended claims. The invention will best be understood from the following description when read in connection with the accompanying drawings.

DESCRIPTION OF PREFERRED EMBODIMENTS

Figure 1:
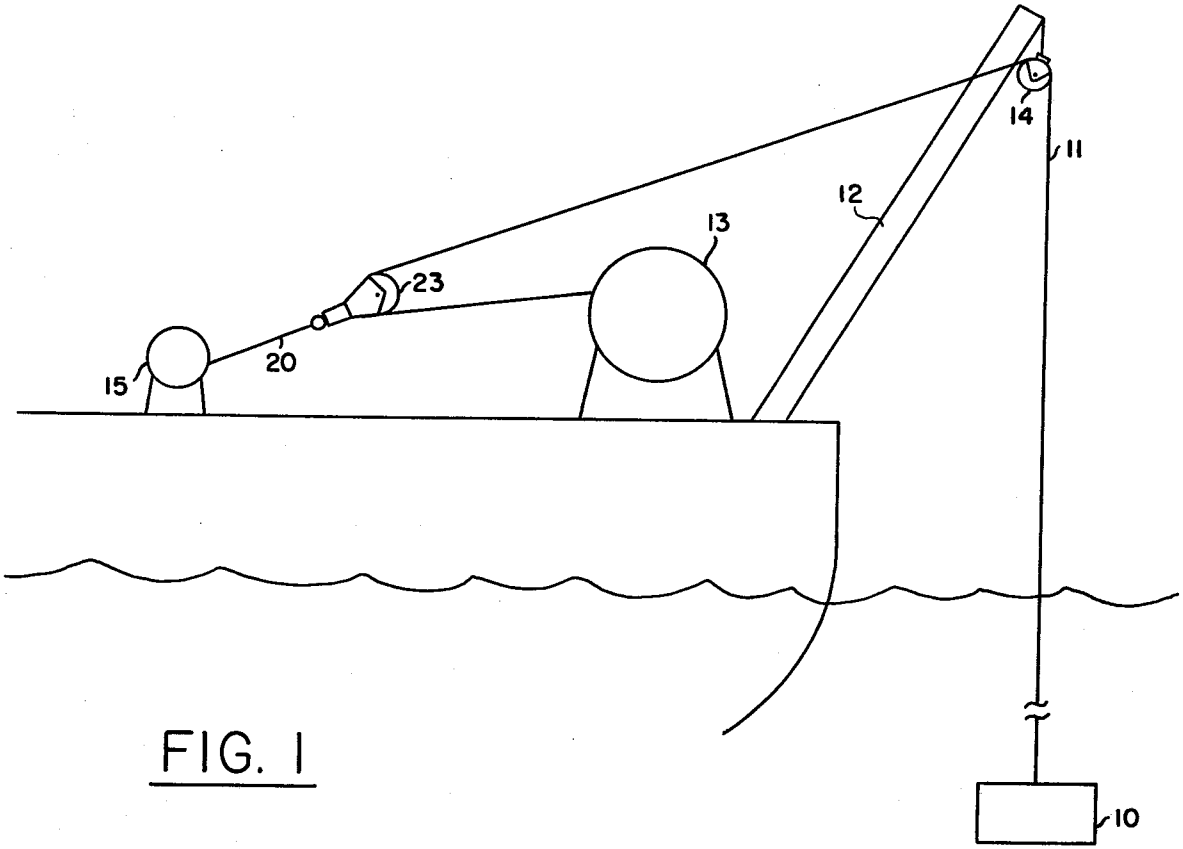
FIG. 1 is a schematic diagram of a typical arrangement using the present invention, a ship motion compensator.

Referring now to FIG. 1, an instrumentation package 10, such as a sonobuoy array, is supported by an instrumentation cable 11 extending from the end of a crane 12. The depth of the package in the ocean depends upon the amount of instrumentation cable payed out by a deck winch 13 through a sheave 14 suspended from the crane.

Figure 2:
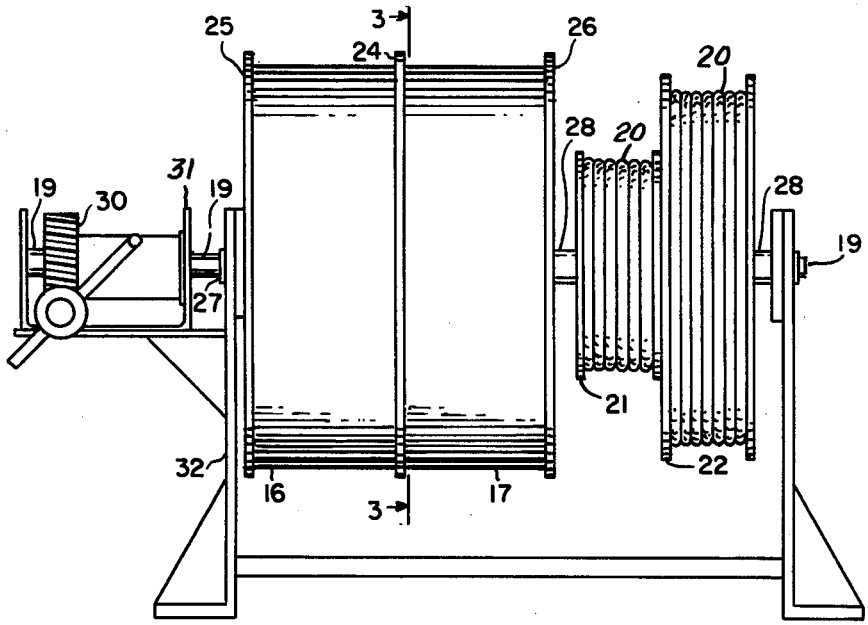
FIG. 2 is a front elevation of the ship motion compensator of FIG. 1.

As noted hereinbefore, oceanographic instrumentation is susceptible to loss due to high transient shock loads in the instrumentation induced by ship motion and high sea-state conditions. The risk of loss is particularly high when the winch is being used to recover the instrumentation package. To compensate for ship motion, a ship compensator 15 is utilized which employs large power springs in drums 16 and 17 to tension a compensator cable 20 from a reel 21 or 22 as shown in FIG. 2. The compensator cable 20 is attached to a sheave 23 (FIG. 1) through which the instrumentation cable 11 is reeved. As the ship rolls in the ocean, compensator cable is payed out and reeled in by the power springs operating on the reel 21 or 22, whichever reel is chosen, as will be described hereinafter. The power springs thus maintain a fairly uniform tension on the compensator cable 20, and therefore compensate for ship motion in the tension of the instrumentation cable.

Figure 3:
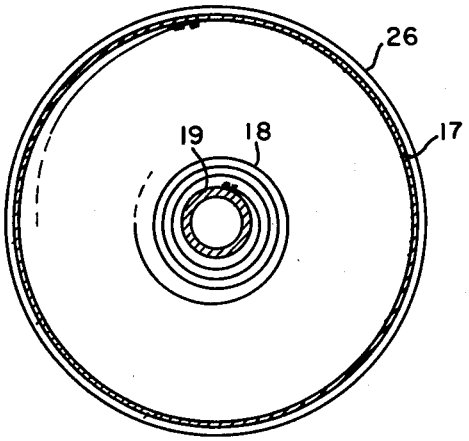
FIG. 3 is a sectional view taken along a line 3—3 of FIG. 2 of a spiral power spring drum in the ship motion 11mpensator.

Referring now to FIG. 3, the power spring in the drum 17 is comprised of a spirally-wound flat strip 18 of high tensile alloy, such as Inconel 625. The inner end of the spiral spring is secured to an axle 19 which passes through the drums 16 and 17 and the reels 21 and 22. In operation, the axle remains stationary while the drums 16 and 17 turn with the reels 21 and 22. To accomplish that, the drums are secured to each other by a common wall 24 while end walls 25 and 26 are secured to sleeves 27 and 28 over the axle 19. The sleeve 28 extends through and is secured to the reels 21 and 22 so that as the reels turn, the drums 16 and 17 turn while the axle 19 remains stationary. Consequently, as compensator cable is payed out by the reels under tension due to ship motion, the drums 16 and 17 turn to tighten the spiral springs. The energy thus stored serves to reel in the compensator cable when ship motion changes direction.

To adjust the spiral spring's tension initially, a worm gear 30, shown in FIG. 2, is connected to the axle 19 to turn the axle while no compensator cable is being payed out or reeled in. The worm gear is supported by a U-shaped bracket 31 attached to a compensator frame 32. When tensioned, the springs exert a torque to the selected cable reel such that the tension on the instrumentation cable can be maintained fairly uniform, with low spring rate for any ship motion, over a large range of tidal and sea-state conditions.

Figure 4:
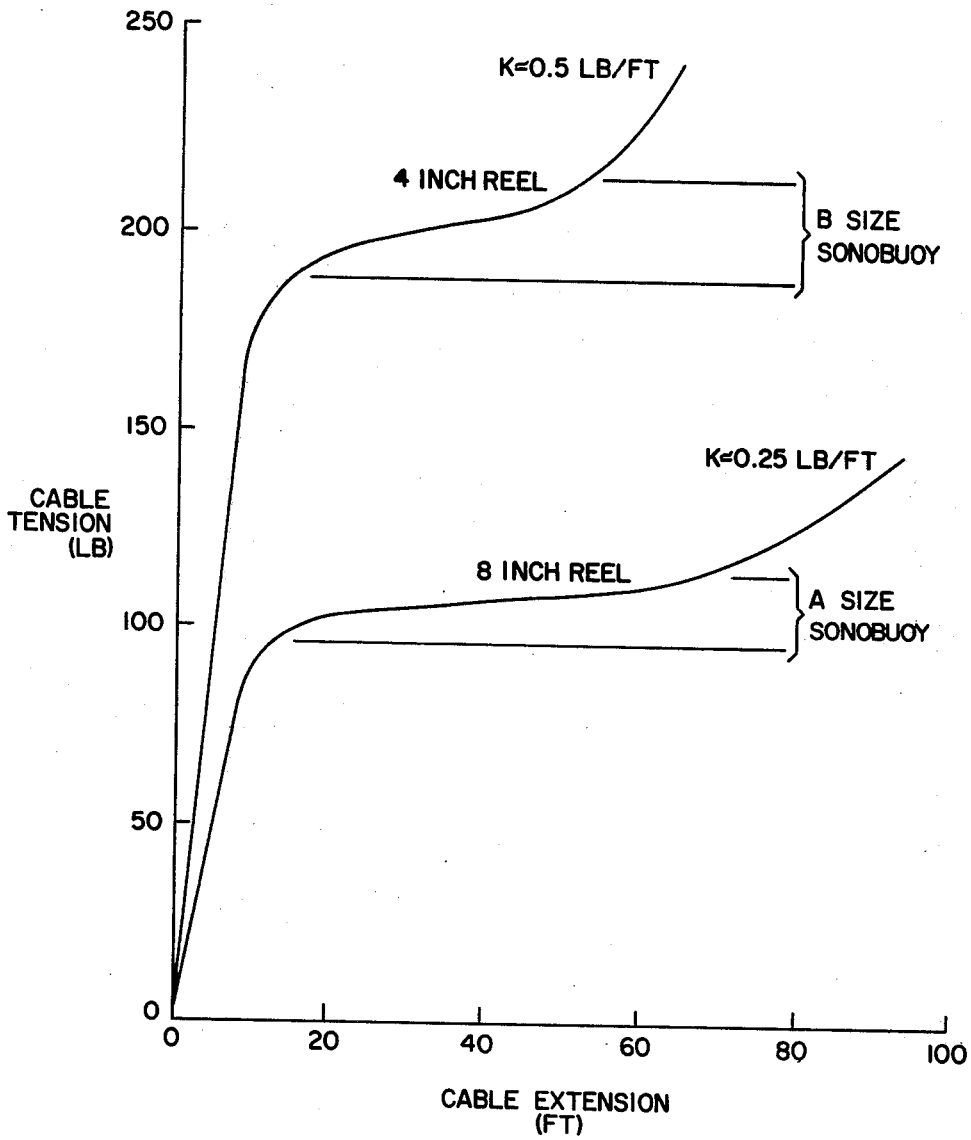
FIG. 4 is a diagram illustrating the load/extension characteristics of the ship motion compensator of FIG. 2 in the arrangement of FIG. 1.

The preferred method of practicing the invention is to use this basic spring and reel assembly, and provide at least the two reels shown of diameters than will exert differing line pulls, as illustrated by the curves in FIG. 4. During a recovery operation the reel to be used can be selected to match the weight and recovery speed for the particular sonobuoy being tested. Thus, as illustrated in FIG. 2, two reels are used of diameters eight inches and four inches. These reels will exert a nominal line pull of 100 and 200 pounds, respectively. Since the arrangement is equipped with a pretension adjustment, and provision is made for either bolting or welding the frame to the ship's deck, ship motion compensation is provided.

The dimensions of a typical compensator are: 12 inches wide by 36 inches long by 16 inches high, and it weighs approximately 280 pounds. It may be constructed of corrosion-resistant materials, and the springs may have a fatigue life of over 500,000 cycles (the equivalent to recovering 500 deep sonobuoys).

The ship motion compensator can be implemented with deck recovery machinery in various ways. The arrangement shown in FIG. 1 is typical. It shows the instrumentation cable 11 routed around a sheave 23 at the end of the compensator cable before going to the deck winch. With this arrangement the tension on the compensator cable is twice the tension of the instrumentation cable, and the suspension spring rate is 50 percent of the ship motion compensator spring rate.

Assuming that the instrumentation package being recovered is a sonobuoy array and the recovery speed is 200 feet per minute, then the sonobuoy cable tension (steady state) will vary with depth between 100 and 90 pounds. The tension at the compensator cable will, therefore, be between 200 and 180 pounds. By slightly adjusting either the spring tension or the recovery speed, the motion of the sheave 21 at the end of the compensator cable can be centralized between the winch 13 and the compensator 15.

For most recovery operations the winching is usually performed "over-the stern"; this position being the most favorable for avoiding the effects of the roll motion. At the center-stern position, the predominant motions are heave and the vertical component of pitch. The frequency of this motion depends on the type of ship being used. Most ships have pitch mode frequencies between 0.15 and 0.25 Hertz, with vertical stern motions of between eight and ten feet in Sea State 4 waves. It is therefore apparent that to effectively attenuate this motion and prevent its being transmitted to the instrumentation cable, the suspension frequency must be considerably less than 0.15 Hertz.

The natural frequency of a single degree of freedom suspension system is given by:

$$fo = 1/2\pi \cdot K/M \text{ Hertz,}$$

where K is the length-dependent cable stiffness; and $M = M_s + M_w + M_c$. The subscripts s, w and c denote sensor mass, coupled water mass, and cable mass.

Figure 5:
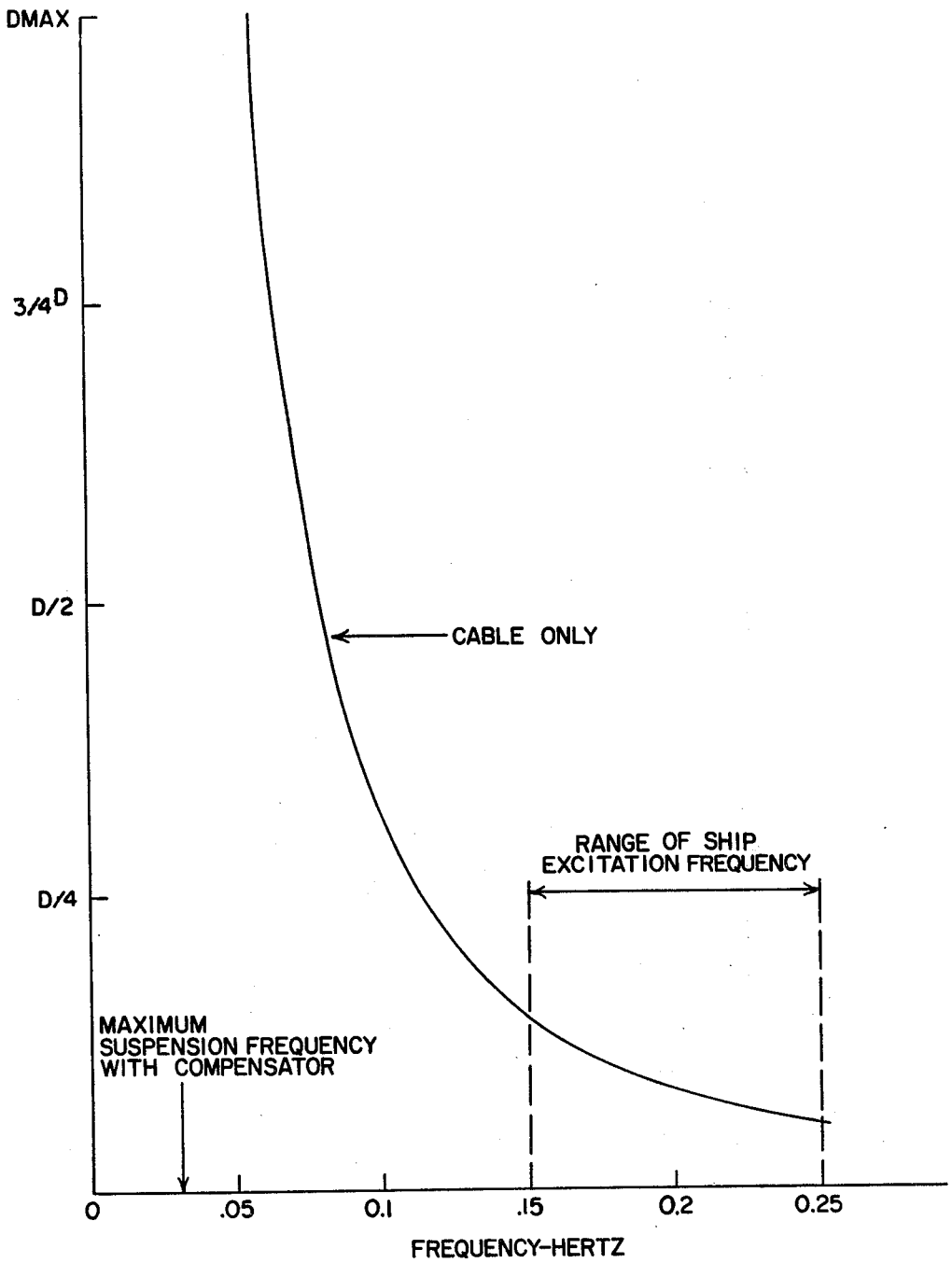
FIG. 5 is a diagram illustrating the natural suspension frequency of a sonobuoy suspended in the ocean.

Using a typical sonobuoy array as an example, the natural frequency, without any compensator, will vary as plotted in FIG. 5, where the lowest frequency at $D_{max}$ is 0.056 Hertz. It is therefore obvious that, at between D/8 feet and D/16 feet from the surface, the suspension will pass through a critical resonant condition. With the ship motion compensator included in the suspension, the natural frequency is significantly lowered and will not exceed 0.025 Hertz even with the array near the surface. With such a low suspension frequency the dynamic forces on the cable will be greatly attenuated.

Although particular embodiments of the invention have been described and illustrated herein, it is recognized that modifications and equivalents may readily occur to those skilled in the art and consequently it is intended that the claims be interpreted to cover such modifications and equivalents.

The embodiments of the invention in which an exclusive property or privilege is claimed are described as follows:

1. Apparatus for compensating ship motion in order to protect a cable by which a load is supported in the ocean comprising an axle, a compensator cable and a power spring, a plurality of reels of different diameters mounted on said axle for said compensator cable, one end of said cable being connected to a selected one of said reels and the other end being free, and a sheave connected to the free end of said compensator cable, said load cable being reeved through said sheave, wherein said power spring is so connected between said compensator cable reels and said axle as to exert a torque to said reels in a direction to wind said compensator cable on said selected reel whereby the tension on the load cable is maintained fairly constant, and said power spring is comprised of a flat strip of high-tensile metal spirally wound around said axle, said spirally wound flat strip having one end connected to said axle of said compensator cable reels, and the other end connected to said reels.

2. Apparatus for compensating ship motion in order to protect a cable by which a load is supported in the ocean comprising an axle, a compensator cable, a plurality of reels of different diameters on said axle for said compensator cable, one end of said compensator cable being connected to a selected one of said reels and the other being free, a sheave connected to the free end of said compensator cable, said load cable being reeved through said sheave, and a plurality of power spring so connected in parallel between said compensator cable reel and said axle as to exert a torque to said reel, whereby the tension on the load cable is maintained fairly constant.

* * * * *